US005351915A

United States Patent [19]

Aandalen

[11] Patent Number: 5,351,915

[45] Date of Patent: Oct. 4, 1994

[54] HELICOPTER DECK

[76] Inventor: Ernst Aandalen, N-2834 Nygard, Norway

[21] Appl. No.: 5,245

[22] Filed: Jan. 15, 1993

[30] Foreign Application Priority Data

Jan. 24, 1992 [NO] Norway ..... 920323

[51] Int. Cl.[5] ..... B64F 1/00

[52] U.S. Cl. ..... 244/114 R; 52/483.1

[58] Field of Search ..... 244/114 R; 52/821, 630, 52/825, 588, 674; 14/73, 73.1, 73.5, 74, 78

[56] References Cited

U.S. PATENT DOCUMENTS

| | | | |
|---|---|---|---|
| 3,080,021 | 3/1963 | Muir | 52/630 |
| 3,172,508 | 3/1965 | Doering et al. | 244/114 R |
| 3,469,509 | 9/1969 | Hutchinson | 14/73 |
| 3,685,229 | 8/1972 | Sale, Jr. et al. | 52/630 |
| 4,048,960 | 9/1977 | Barnidge et al. | 52/588 |
| 4,758,128 | 7/1988 | Law | 52/588 |
| 4,894,967 | 1/1990 | Morton | 52/630 |
| 4,951,992 | 8/1990 | Hockney | 52/588 |
| 5,033,147 | 7/1991 | Svensson | 52/588 |

*Primary Examiner*—Michael S. Huppert
*Assistant Examiner*—Anne E. Bidwell
*Attorney, Agent, or Firm*—D. Peter Hochberg; Mark Kusner; Michael Jaffe

[57] ABSTRACT

A helicopter deck comprises a supporting main frame (1, 2) which at least comprises a preferably polygonal circumferential frame (1), possibly connected with intermediate carrying beams (2), the main frame (1, 2) forming a supporting frame for the actual deck consisting of elongate, mutually "semi-rigidly" (mortice/tenon) connected deck elements (3), e.g. in the form of extruded aluminium profiles. One has aimed at providing a distribution of point loads (from helicopter wheels) from one loaded deck element (3) across the same and the adjacent deck elements (3), thereby giving rise to helicopter deck weight reductions. To this end, at least most of the deck elements (3) are connected with at least one underlying, lateral, load distributing beam (5) which is freely suspended and, thus, not connected with or supported on the main frame (1, 2).

4 Claims, 4 Drawing Sheets

HELICOPTER DECK

The invention relates to a helicopter deck (helipad), comprising a supporting main frame including a circumferential frame forming the external limitation of the helicopter deck in the horizontal plane, as well as one or more intermediate carrying beams, said main frame forming a supporting frame for the actual deck consisting of mutually connected deck elements.

Simple, cheap and light helipads of this kind are known to be mounted on ships, unmanned offshore platforms and rigs, etc.

Even if these known helicopter decks are lightweighted and otherwise quite satisfactory in use, they, nevertheless, suffer from substantial deficiencies and disadvantages primarily associated to their insufficiency to take up point loads (from helicopter wheels); likewise, a further weight saving will represent a valuable further development of such helicopter decks.

The present invention is based on the acknowledgement that the utilization of beam capacities in conventional helicopter decks is far too low and that this leads to an increased overall weight in relation to an ideal weight corresponding to the optimally lowest weight which is consistent with the forces to be taken up. Relatively high deck weight necessitates, of course, a corresponding dimensioning of the sub structure (below the main frame). A further weight reduction will represent substantial manufacturing and installation savings.

A point load (from a helicopter wheel) acting within the span of a deck element will normally have a distributing width effect merely inconsiderably exceeding the "wheel track" width of the load from the wheel. This is due to the relatively loose clamping between adjacent deck elements and the inconsiderable thickness of the deck plate.

According to the present invention, one has provided an efficient and particularly advantageous distribution of such point loads across several adjacent deck elements, so that the deck element subjected to the point load, in spite of relatively slender cross section, is not deformed to a harmful degree.

In accordance with the following claims, this is realized by means of one or more load distributing beams which extend laterally of the deck elements and are connected to these but not to said main frame.

The deck elements which, preferably, are formed as extruded aluminium profiles having an upper continuous, partial deck forming supporting flange and three lower flanges as well as three intermediate webs, are clamped to said one or more underlying, lateral, load distributing beams through e.g. two of said lower flanges. Without connection to the main frame, said one or more load distributing beams are floating or freely suspended beams, merely connected to each deck element.

A wheel load on one deck element will result in a vertical deflection of the same, whereby associated load distribution beam(s) is/are pressed down and, due to the clamp connection of the load distribution beam(s) to the remaining deck elements, also the neighbouring elements are urged to be bent downwards. Thus, the wheel load will become distributed over a much wider part of the deck than what would have been obtainable without one or more such floating or freely suspended load distribution beam(s).

The actual load distribution width of point loads is dependent on the relative rigidity between the deck elements and the deck element span. Increased load distribution beam rigidity results in larger load distribution. Likewise, increased deck element span results in larger load distribution width. In a practical embodiment, one may use a maximum deck element span of about 5.5 meters, wherein for each deck element span two load distribution beams are used.

The width of the point loads from each helicopter wheel is about 300 mm, and each deck element may then suitably be dimensioned with a width of 500 mm, so that the point load width corresponds to the deck element width plus 100 mm at either side of the deck element concerned, as considered to be active supporting surfaces. However, there is nothing to prevent one from dimensioning the deck elements with a width of about 300 mm. Usually, the height will be about 150

The deck element may appropriately be formed as deck boards (plates/stays) having cooperating coupling means of the mortice and tenon type which only are in a position to establish a "semi-rigid" connection between adjacent deck elements. The bottom flange of the deck elements is attached to the main frame, suitably by means of clips. Likewise, it is appropriate to use clips when attaching the load distribution beam(s) to the deck elements. On the other hand, as mentioned, no connection exists between the load distribution beam(s) and the main frame.

The invention is further explained in the following in association with an exampled embodiment illustrated in the accompanying drawings, wherein:

FIG. 1 show in perspective a principle sketch illustrating the construction in principle of a helicopter deck according to the present invention.

Figure 1:
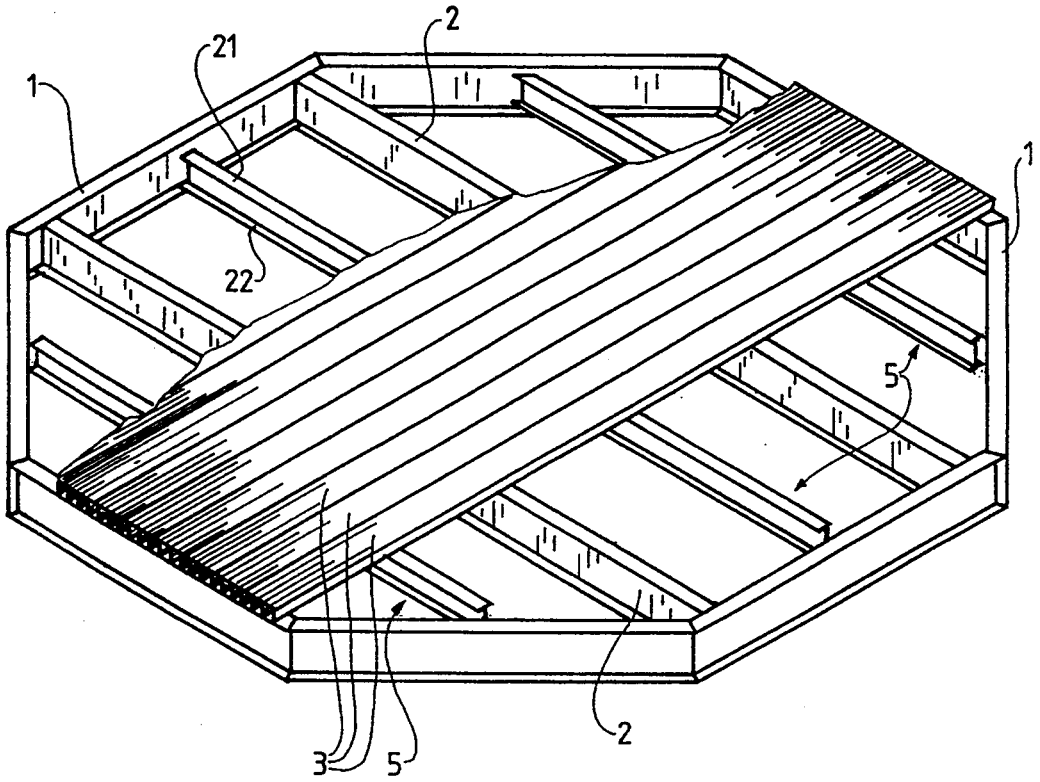
FIG. 1 is a strongly simplified, diagrammatical representation illustrating a helicopter deck formed in accordance with the present invention, seen from above, and wherein most of the deck elements are omitted in order to show the underlying structure.

The reference numeral 1 then denotes an octagonal circumferential frame included in the helicopter deck's main frame which, moreover, comprises intermediate beams 2. In the fundamental embodiment of FIG. 1, said main frame comprises two such intermediate beams 2 which, at the ends thereof, are rigidly anchored to the circumferential frame 1. According to FIG. 2, the main frame 1,2 comprises three intermediate beams 2. However, the number of intermediary beams 2 may vary from one to more than three and, in very small decks be omitted completely, within the scope of the invention.

Figure 2:
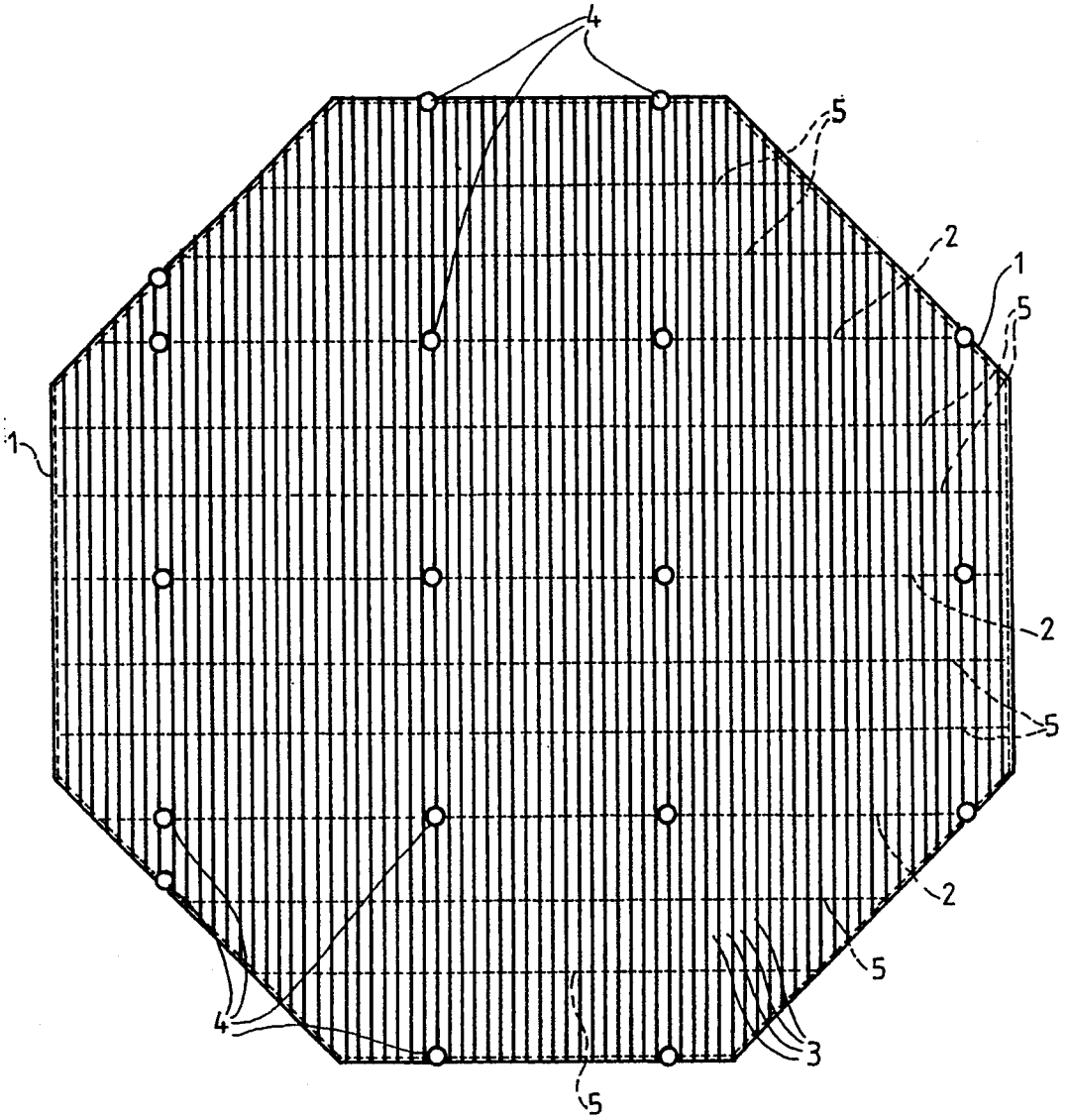
FIG. 2 illustrates a top plane view, corresponding to FIG. 1, of a helicopter deck, showing more clearly how a practical embodiment has been built up.

Besides the main frame 1,2, a conventional helicopter deck comprises a number of relatively loosely joined (semi-rigidly coupled), in parallel extending deck elements 3, which together form the actual deck, covering the entire main frame 1,2, see FIG. 2 (in FIG. 1, most of the joined deck elements 3 have been removed in order to show the underlying structure).

In FIG. 2, the junction points between intermediate main frame beams 2 and underlying load accommodating structure have been shown in the form of circles and denoted by the reference numeral 4. Such junction points do not form the subject matter of the present invention.

In accordance with the present invention, each deck element is attached to one or more, e.g. three, FIG. 1, or eight, FIG. 2, underlying, lateral beams 5.

These underlying, lateral beams 5—the attachment of which to the deck elements 3 being further explained in connection with FIGS. 3 and 4—end freely, i.e. without any connection to the main frame 1,2. Thus, they are only in a position to transfer og distribute loads between the deck elements 3, and they are dimensioned correspondingly.

The attachment of these load distribution beams 5 to the deck elements 3 is, thus, merely determined by this load transfer and distributing function between the deck elements; the attachment may be effected by means of any kind of appropriate fasteners, e.g. of the clamp or clip type.

Figure 3:
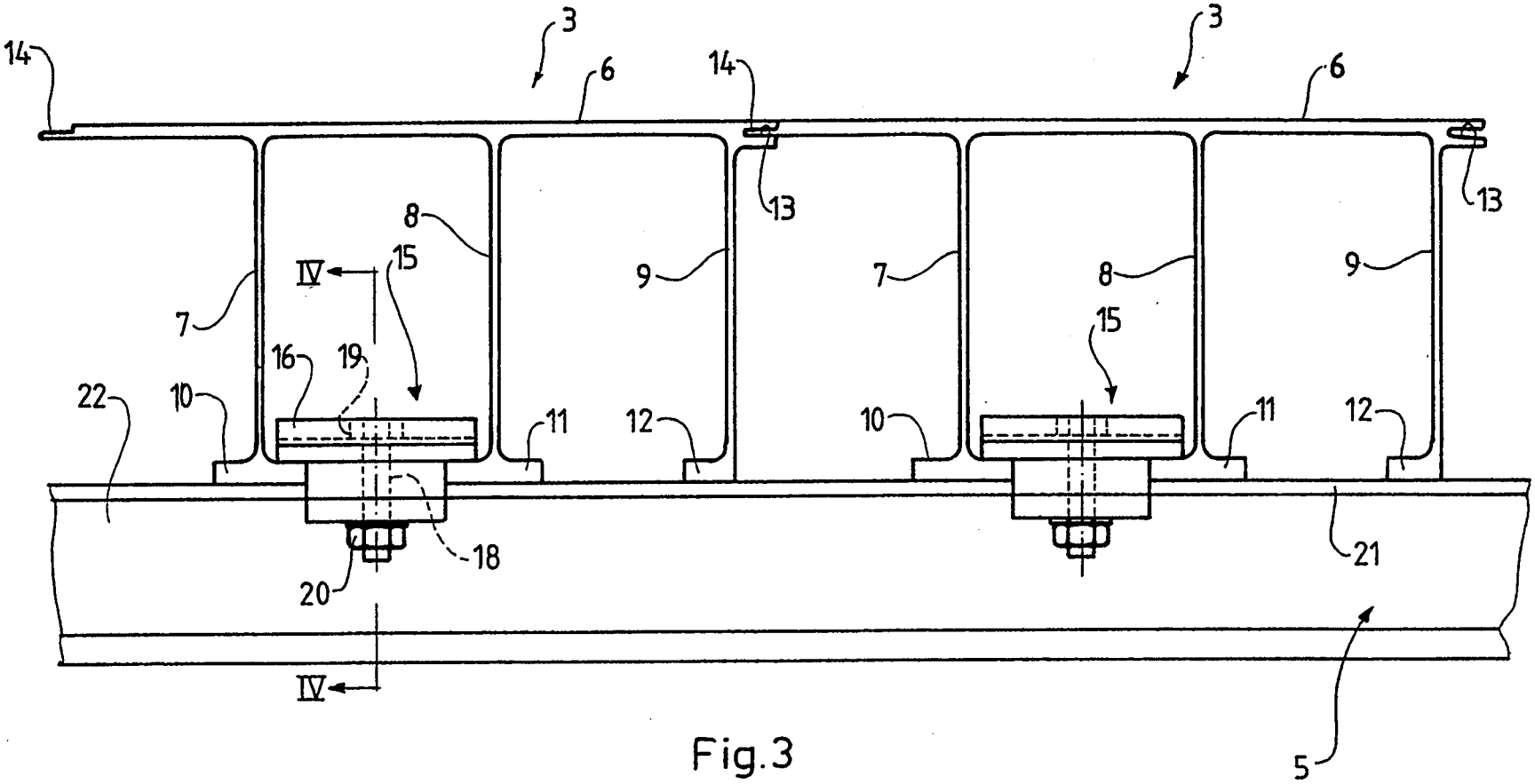
FIG. 3 illustrates a partial side elevational view of two deck elements coupled together by mortice and tenon as well as their attachment to an underlying, lateral load distribution beam.
Figure 4:
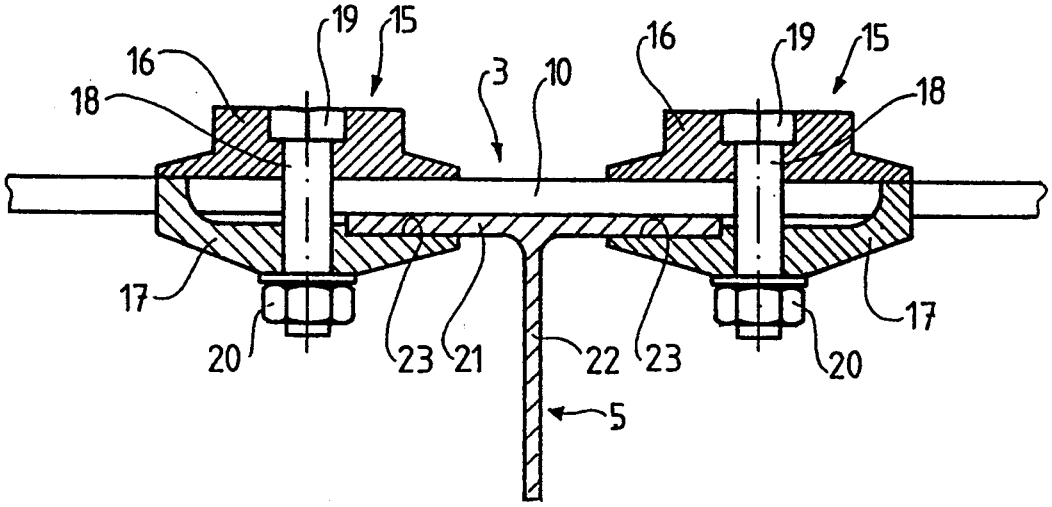
FIG. 4 illustrates a cross-sectional view along the line IV—IV in FIG. 3.

Now, reference is made to FIGS. 3 and 4, which in side elevational view and cross-sectional view, respectively, show the coupling of two adjacent deck elements 3 to each other and to one load distribution beam 5, respectively.

According to FIG. 3, each of two adjacent deck elements, e.g. in the form of extruded aluminium profiles, comprises an upper horizontal partial deck forming carrying flange 6 which, through three parallel, vertical webs 7, 8, 9, is connected to three lower flanges 10, 11, 12.

The upper carrying flanges 6 of the deck elements 3 are formed with complementary engagement means of the mortice 13 and tenon 14 type, establishing a kind of "semi-rigid" jointing between the deck elements 3, said jointing not or to a very small degree being load transferring from one deck element to a neighbouring element.

In order to avoid harmful effects of point loads (from helicopter wheels) on single elements 3, the deck elements 3—at least within the central portion of the helicopter deck but, preferably, over the entire area of the deck—are connected with the one or more underlying, in relation to the deck elements 3 laterally extending load distribution beams 5; in the embodiment shown, FIG. 3 and 4, by means of in per se known clips or clamps, generally denoted by the reference numeral 15.

At each connection point between a deck element 3 and the associated load distribution beam 5, two such clamps 15 are arranged, each consisting of an upper jaw 16 and a lower jaw 17 and a screw bolt 18 having a fixed head 19 and a nut 20, connecting the jaws. The upper jaws 16 are formed for countersunk accommodation of the bolt head 19.

The load distribution beam 5 which, preferably, has an Ishaped cross section, is shown only partially in FIGS. 3 and 4, merely the upper flange 21 and a portion of the web 22 being visible.

Each of the lower jaws 17 is formed with a cavity 23 for the accommodation of the adjacent portion of the load distribution beam 5, in that opposing clamp surfaces on the upper and lower jaws 16, 17 causing clamping of two adjacent lower flanges 10, 11 of each deck element 3.

A point load from a helicopter wheel acting within the span of one deck element 3—e.g. the left deck element's 3 span according to FIG. 3—will normally have a distributing effect in the direction of width, i.e. in the lateral direction of the deck element, which only inconsiderably exceeds the width of the "wheel track"; this being due to the relatively loose (semi-rigid) joining between adjacent deck elements and the rather inconsiderable thickness of the deck board.

In a helicopter deck formed in accordance with the present invention, using at least one lateral, freely suspended load distribution beam, such a point load on one deck element will result in a usual vertical deflection of this (left) deck element, whereby the associated load distribution beam(s) 5 is pressed down and, due to the clamp connection 15 of the load distribution beam(s) with the other deck elements (i.a. the one to the right in FIG. 3), also the neighbouring elements 3 are urged to be deflected downwards, so that a load distribution is caused over a much wider portion of the deck (i.e. in the lateral direction of the deck elements 3) than with conventional helicopter decks. When using a socalled load distributing principle for the calculation of the stength of the helicopter deck, this point load distribution will manifest itself in that the dimensions may be reduced, resulting in reduced deck weight.

I claim:

1. A helicopter deck (helipad) comprising a supporting main frame (1,2) which at least comprises a polygonal circumferential frame (1), connected with intermediate carrying beams (2), said main frame (1,2) forming a supporting frame for the actual deck comprised of elongate, deck elements (3), the deck elements (3) joined together to permit limited relative motion and most of the deck elements (3) connected with at least one underlying, lateral load distribution beam (5) which is freely suspended and, thus, not connected with or supported on the main frame (1,2), the task thereof being to distribute point loads between adjacent deck elements (3), said deck elements (3), each comprising an upper carrying flange (6) forming a portion of the deck and being provided with a mortice (13) along one longitudinal edge of said flange and a corresponding, complementary tenon (14) along the other longitudinal edge of said flange as well as two or more vertical webs (7–9) extending into lower horizontal flanges (10–12) formed for connection with the load distribution beam (5), and that the load distribution beam (5), has an upper flange (21) attachable to said deck elements.

2. A helicopter deck as defined in claim 1, wherein the deck elements (3) are connected with the load distribution beam (5) by means of clamp connections (15).

3. A helicopter deck as defined in claim 2, characterized in that each of said clamp connections (15) comprises two jaws (16, 17) and a clamp bolt (18–20) connecting the jaws, an upper jaw (16) being formed for resting clampingly against a top surface of the lower horizontal flanges (10, 11) of the deck elements (3), a lower jaw (17) being formed with a laterally open, downwardly closed cavity (23) for the accommodation of a free edge portion of the upper flange (21) of load distribution beam (5) .

4. A helicopter deck comprising a supporting main frame including at least a circumferential frame, said main frame forming a supporting frame for the actual helicopter deck comprised of a plurality of narrow and elongate deck elements, each of said narrow and elongate deck elements comprising an upper carrying flange forming a portion of said helicopter deck, said flange at one longitudinal edge thereof being provided with a tenon and at a second longitudinal edge thereof with a mortice complementarily shaped to said tenon, a tenon of one deck element being engageable into a mortice of an adjacent deck element, thus establishing a semi-rigid interconnection between adjacent deck elements, and at least two vertical webs extending into lower horizontal flanges, at least most of said deck elements being connected to at least one underlying, laterally extending load distributing beam, said narrow and elongate deck elements are interconnected to said load distributing beam by means of clamp connections, each of said clamp connections comprising two cooperating jaws, an upper jaw formed for resting clampingly against a top surface of said lower horizontal flanges of said deck elements, a lower jaw being formed with a cavity for the accommodation of an edge portion of an upper flange of said load distributing beam, said load distribution beam not connected to or supported on said main frame, the task of said at least one load distribution beam being to distribute point loads between adjacent deck elements.

* * * * *